US007287681B1

(12) United States Patent
Wen

(10) Patent No.: US 7,287,681 B1
(45) Date of Patent: Oct. 30, 2007

(54) PALM NAILER

(75) Inventor: Wan-Fu Wen, Taipei Hsien (TW)

(73) Assignee: De Poan Pneumatic Corp., Taipei (TW)

( * ) Notice: Subject to any disclaimer, the term of this patent is extended or adjusted under 35 U.S.C. 154(b) by 0 days.

(21) Appl. No.: 11/458,682

(22) Filed: Jul. 20, 2006

(51) Int. Cl.
*B25C 1/00* (2006.01)

(52) U.S. Cl. ..... 227/120; 227/130; 227/148

(58) Field of Classification Search ..... 227/120, 227/130, 119, 148, 156, 110
See application file for complete search history.

(56) References Cited

U.S. PATENT DOCUMENTS 2,801,415 A * 8/1957 Jenny ..... 227/130
3,820,705 A * 6/1974 Beals ..... 227/113
4,741,467 A * 5/1988 Gassner et al. ..... 227/8
6,364,192 B1 * 4/2002 Lin ..... 227/113
6,761,299 B2 * 7/2004 Caringella et al. ..... 227/10
6,779,697 B2 * 8/2004 Lin ..... 227/120
6,932,261 B2 * 8/2005 Huang ..... 227/120
7,032,797 B2 * 4/2006 Liao ..... 227/142

FOREIGN PATENT DOCUMENTS

TW 551260 9/2003

* cited by examiner

*Primary Examiner*—Scott A. Smith

(57) ABSTRACT

A palm nailer includes a main body, a rotating table mounted on the main body, a mounting seat mounted on the rotating table to connect with a nail magazine. The mounting seat and the nail magazine can rotate with the rotating table. A brake lever is pivotally engaged with the rotating table. The palm nailer further includes a denticulate plate with a number of alveolus formed around the periphery thereof. The brake lever can be resisted by the alveolus to prevent the rotating table rotating so that the nail magazine is fixed at a proper position. The brake lever may also be released from the alveolus to make the rotating table rotate so that the nail magazine can rotate around the main body.

5 Claims, 5 Drawing Sheets

PALM NAILER

BACKGROUND

The present invention relates to a palm nailer and, more particularly, to a palm nailer with a nail magazine which can be rotated around the palm nailer.

Nowadays, a palm nailer is a pneumatic nailing device as a substitute for a conventional hammer by hand. Initial palm nailers are only filled with one nail so that only one nail can be ejected at a time. With the development of technology, current palm nailers have a nail magazine which has a plurality of nails aligned in series so that nails can be ejected successively.

However, the palm nailer with a nail magazine is unduly bulky in size so that it is often interfered by an impediment formed adjacent to the nailing position. Furthermore, the nail magazine of the palm nailer is arranged at the side of the palm nailer so that the nail magazine is often interfered by the impediment arranged adjacent to the nailing position. Therefore, the nail is difficulty nailed at a proper nailing position.

To solve the above problem, a conventional palm nailer disclosed in TW Patent No. 551260 and U.S. Pat. No. 6,932,261, can rotate the nail magazine around the palm nailer. The palm nailer includes a main body and an ejecting tube. A plurality of through holes aligned in series along a circle or a containing chamber are arranged at a connecting portion between the main body and the ejecting tube. A plurality of balls are arranged in the through holes respectively or arranged in the containing chamber configured for making the nail magazine rotating around the main body. If the nail magazine is interfered by an impediment adjacent to the nailing position, the nailing magazine can be posited to a proper position by rotating to avoid the impediment interfering.

However, the balls are easily popped out of from the through holes or the containing chamber. Especially, if the palm nailer is used to eject the nails successively, the balls are easily popped out of the through holes or the containing chamber so that the nail magazine swings is continuously under an unstable condition.

What is needed, therefore, is a palm nailer with a nail magazine which can rotate around the palm nailer and be fixed at a certain position without swing at a time.

BRIEF SUMMARY

A palm nailer according to a preferred embodiment, includes a main body, an ejecting tube, a nail magazine, a denticulate plate, a rotating table, a mounting seat, a brake lever and an elastic member. The main body has a connecting sleeve and a shaft driven by high-pressure air configured for moving in the connecting sleeve. The connecting sleeve has a containing chamber defined therein configured for containing a compression spring. One distal end of the ejecting tube inserts into the containing chamber to be pressed by the compression spring, and the ejecting tube has a guiding hole configured for guiding one of the shaft and the nail. The nail magazine is mounted at a side of the ejecting tube and has a guiding frame formed thereon. The denticulate plate is fixed on one of the main body and the connecting sleeve and has a plurality of alveolus formed around the periphery thereof. The rotating table is mounted on one of the main body and the connecting sleeve. The mounting seat is mounted at a side of the rotating table and has a chamber defined therein configured for containing the guiding frame. The brake lever is pivotally engaged with the rotating table and has a block formed at a distal end thereof. The elastic member is arranged in the rotating table to push the brake lever for resisting the block by the alveolus.

Comparing with conventional palm nailer, the present palm nailer has following advantages. As the brake lever is pushed by hand to make the block is released from the alveolus, the rotating table is released so that the guiding frame and the mounting seat can rotate with the rotating table. Therefore, the nail magazine can be posited at a proper position by rotating to avoid the impediment interfering. Then the brake lever is released to make the block be resisted by the alveolus and the nail magazine is fixed at the proper position. Therefore, the nail magazine does not swing.

Other advantages and novel features will become more apparent from the following detailed description of present display device, when taken in conjunction with the accompanying drawings.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Reference will now be made to the drawings to describe a preferred embodiment of the present palm nailer, in detail.

Figure 1:
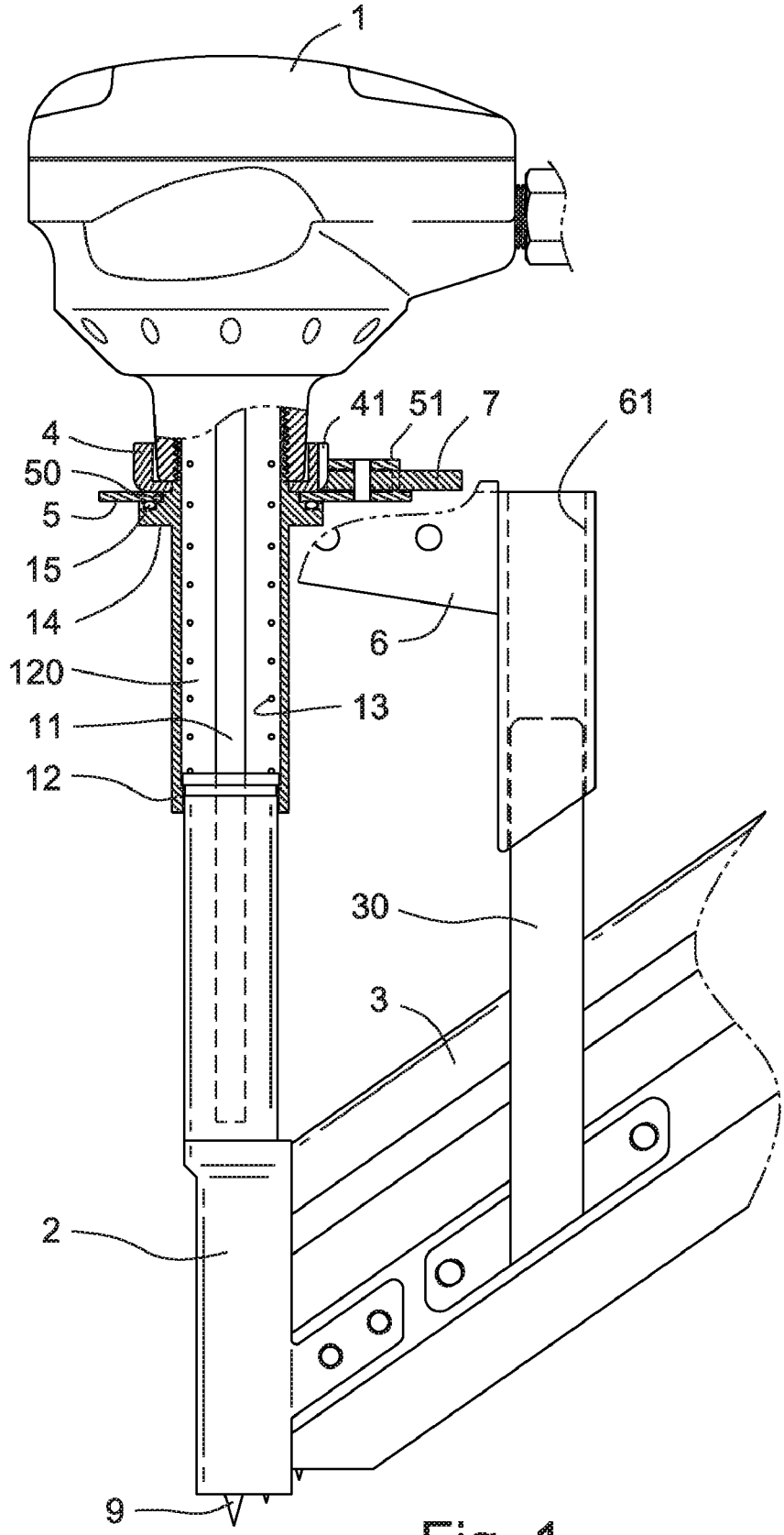
FIG. 1 is a schematic, side view of a palm nailer in according with a preferred embodiment.
Figure 2:
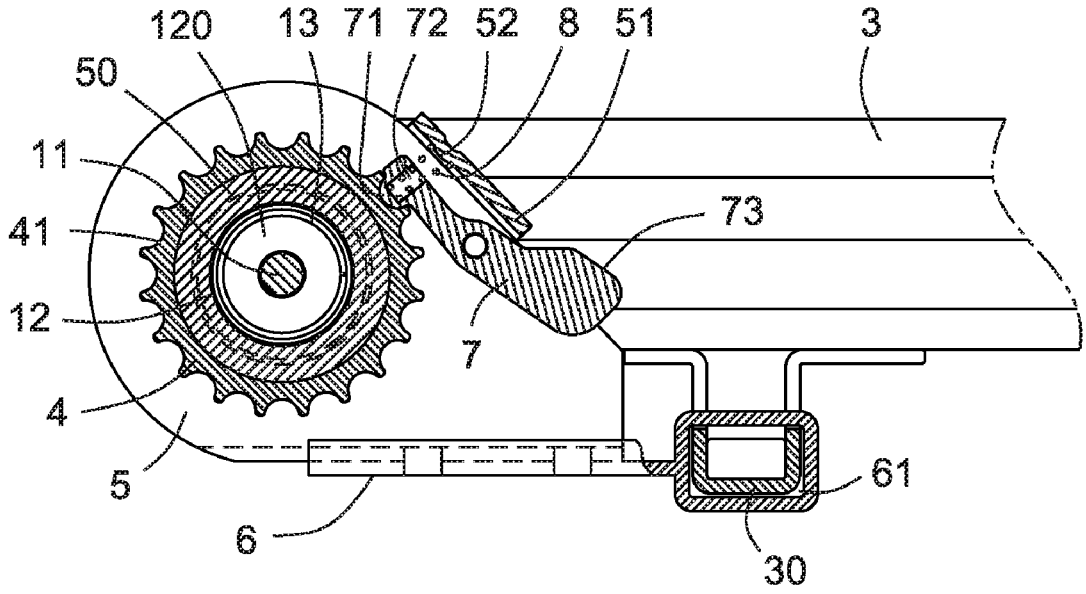
FIG. 2 is a schematic, bottom view of the palm nailer of FIG. 1.

Referring to FIGS. 1 and 2, a palm nailer, in accordance with a preferred embodiment, is shown. The palm nailer includes a main body 1, an ejecting tube 2, a nail magazine 3, a denticulate plate 4, a rotating table 5, a mounting seat 6, a brake lever 7 and an elastic member 8.

The main body 1 includes a shaft 11 driven by high-pressure air configured for ejecting nails, and a connecting sleeve 12 mounted on the main body 1. The containing chamber 120 is defined between the connecting sleeve 12 and the shaft 11 configured for containing a compression spring 13 and the shaft 11 can move along the containing chamber 120. The connecting sleeve 12 is integrally formed with the main body 1. Alternatively, the connecting sleeve 12 is threadedly engaged with the main body 1 as shown in FIG. 1.

One distal end of the ejecting tube 2 is inserted directly or indirectly in the containing chamber 120 of the connecting sleeve 12. The ejecting tube 2 can slide along the connecting sleeve 12 by a press produced by the compression spring 13. The ejecting tube 2 may rotate unrestrictedly in the connecting sleeve 12. The ejecting tube 2 has a guiding hole 20 configured for guiding the shaft 11 or the nail 9 to pass through.

Figure 3:
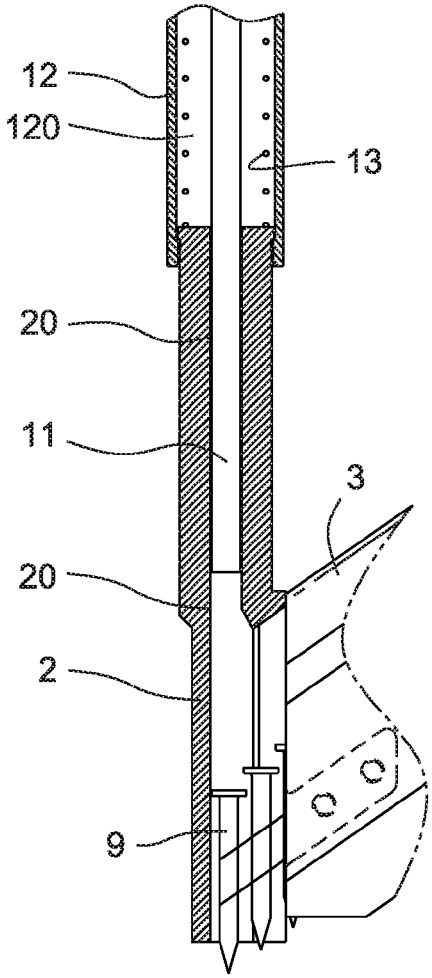
FIG. 3 is a schematic, side view of the palm nailer which the ejecting tube is inserted directly into the connecting sleeve.
Figure 4:
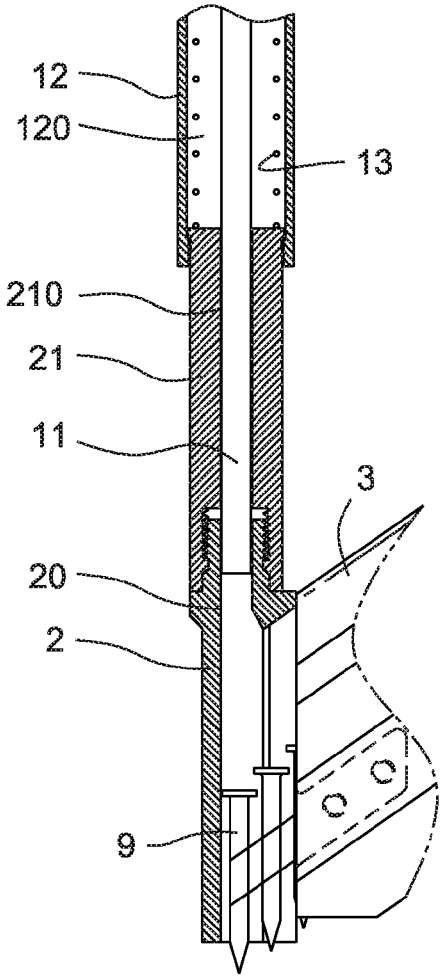
FIG. 4 is a schematic, side view of the palm nailer which the ejecting tube is inserted indirectly into the connecting sleeve.

The distal end of the ejecting tube 2 is inserted directly into the containing chamber 120 of the connecting sleeve 12 (as shown in FIG. 3). Alternatively, the distal end of the ejecting tube 2 is inserted indirectly into the containing chamber 120 of the connecting sleeve 12 through a guiding tube 21 fixed therein (as shown in FIG. 4). The guiding tube 21 has a guiding hole 210 configured for guiding the shaft 11 to move along the guiding tube 21.

The nail magazine 3 is configured for containing a plurality of nails 9 aligned in series. The nail magazine 3 is mounted at a side of the ejecting tube 2 configured for providing nails 9 into the guiding hole 20 in series (as shown in FIGS. 3 and 4). A vertical guiding frame 30 is mounted at the side of the nail magazine 3.

The denticulate plate 4 is fixed on the main body 1 or the connecting sleeve 12 connecting therewith so that the denticulate plate 4 and the main body 1 are assembled together. The denticulate plate 4 has a plurality of alveolus 41 formed around the periphery of the denticulate plate 4. Preferable, the alveolus 41 is arc-shaped.

The rotating table 5 has an engaged hole 50 to be pivotally engaged with the main body 1 or the connecting sleeve 12 connected therewith configured for rotating unrestrictedly.

Figure 6:
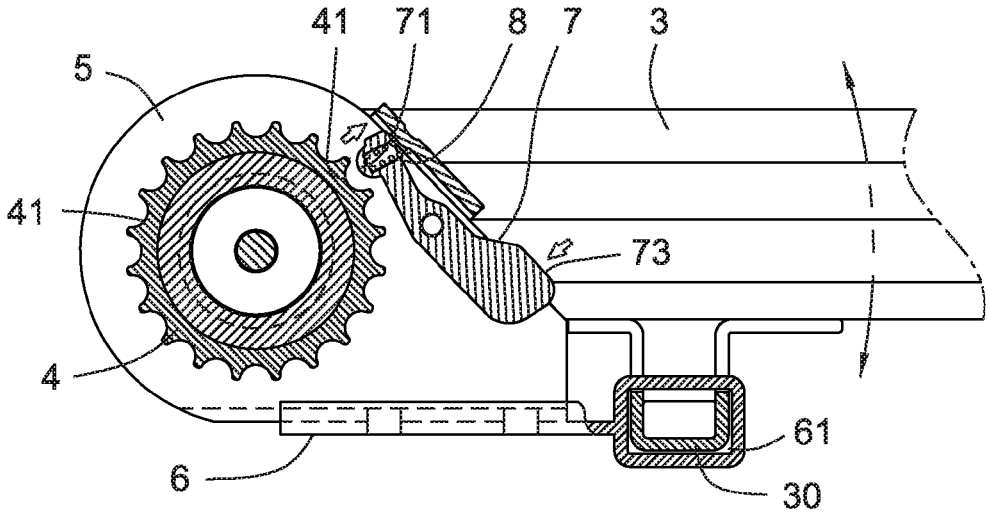
FIG. 6 is a schematic, bottom view of the palm nailer which the block is released from the alveolus.

The mounting seat 6 is mounted at a side of the rotating table 5 to make the mounting seat 6 rotate with the rotating table 5. The mounting seat 6 further includes a chamber 61 (or a groove) defined therein configured for containing the guiding frame 30 of the nail magazine 3 to make the guiding frame 30 move in the chamber 61. The nail magazine 3 can rotate with the rotating table 5 and the mounting seat 6 since the rotating table 5, the guiding frame 30 and the mounting seat 6 are assembled together. (as shown in FIG. 6).

The brake lever 7 is mounted on the rotating table 5 through a pin. A block 71 is formed at one distal end of the brake lever 7 (as shown in FIG. 2). Preferable, the block 71 is an arc-shaped protrusion.

The elastic member 8 is mounted in the rotating table 5 to give a press to push the brake lever 7 so that the block 71 can be resisted by the alveolus 41 of the denticulate plate 4 or pop out of the alveolus 41.

Figure 5:
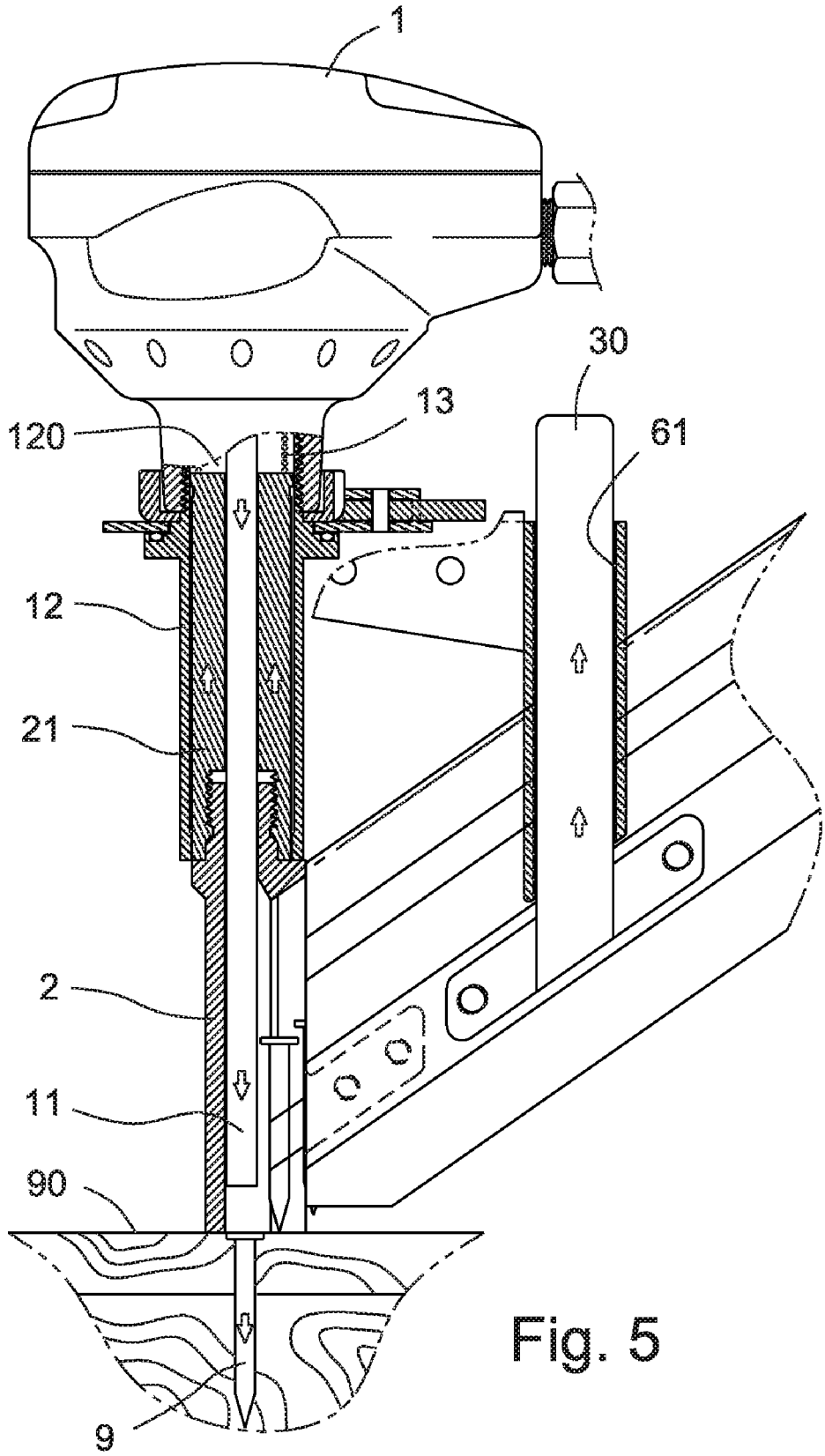
FIG. 5 is a schematic, side view of the palm nailer, which are used, of the FIG. 4.

In operation, the ejecting tube 2 is pressed upon an object 90 which will be nailed to make the ejecting tube 2 or the guiding tube 21 connected therewith (as shown in FIG. 5) compress the compression spring 13 and be constricted into the containing chamber 120 of the connecting sleeve 12. At the same time, the guiding frame 30 moves in the chamber 61. Then the shaft 11 is driven to eject the nail 9 from the ejecting tube 2 into the object 90.

If the palm nailer is used in normal, the brake lever 7 is pushed by the elastic member 8 to make the block 71 is resisted by an alveolus 41 of the denticulate plate 4 so that the rotating table 5 is prevented rotating. Therefore, the guiding frame 30 and the mounting seat 6 are also prevented rotating with the rotating table 5. Thus, the nail magazine 3 is positioned at a certain position without swing to remain the stability of the main body 1. Especially, the nail magazine 3 can be also positioned at the certain position without swing when the palm nailer ejects the nails 9 successively.

Figure 7:
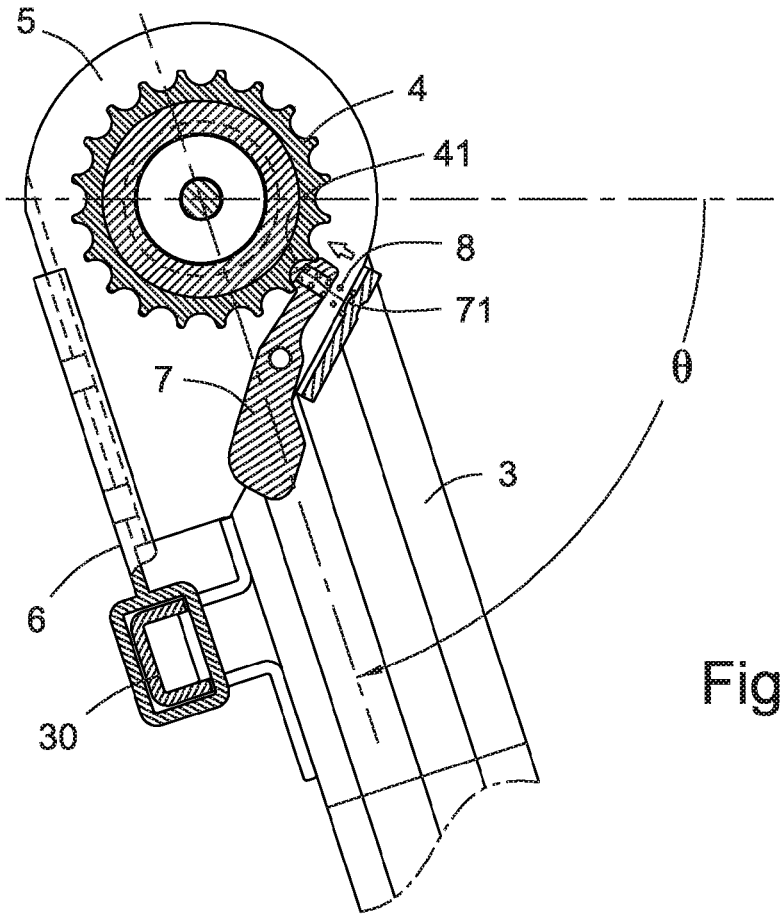
FIG. 7 is a schematic, bottom view of the palm nailer which the block is resisted in the alveolus.

If the nail magazine 3 is interfered by an impediment adjacent to the nailing position, the brake lever 7 is pushed by hand to make the block 71 is released from the alveolus 41 so that the rotating table 5 can rotate now. The guiding frame 30 and the mounting seat 6 rotate with the rotating table 5 to make the nail magazine 3 rotate to another proper position without the impediment interfering (as shown in FIG. 7). Then the brake lever 7 is released to make the block 71 is resisted by another alveolus 41 again for positing the nail magazine 3 at another proper position.

The palm nailer further includes a tray 14 (as shown in FIG. 1) formed on the connecting sleeve 12. An elastic washer 15 is arranged on the tray 14 and connected with the rotating table 5 configured for reducing the vibration of the rotating table 5. Preferably, a protrusion 51 is formed on the rotating table 5 for arranging a latch between the rotating table 5 and the protrusion 51 configured for connected with the brake lever 7. The protrusion 51 has a projection 52 formed thereon (as shown in FIG. 2) configured for fixing the elastic member 8. The brake lever 7 has a corresponding recess 72 formed therein configured for fixing the elastic member 8. The elastic member 8 may be a compression spring, a torsion spring or other elastic element configured for giving a press to push the brake lever 7.

Preferable, the brake lever 7 further includes a glossa 73 formed at one distal end thereof configured for convenient for hand pushing. Especially, when brake lever 7 is pushed to make the block 71 be released from the alveolus 41 (as shown in FIG. 6), the glossa 73 is convenient for the hand contacting to make the nail magazine rotate.

It is to be understood that the above-described embodiment is intended to illustrate rather than limit the invention. Variations may be made to the embodiment without departing from the spirit of the invention as claimed. The above-described embodiments are intended to illustrate the scope of the invention and not restricted to the scope of the invention.

The preferred embodiment can be performed with the above element.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A palm nailer with a nail rotatable magazine, comprising:

a main body, having a connecting sleeve and a shaft driven by high-pressure air configured for moving in the connecting sleeve, the connecting sleeve having a containing chamber defined therein configured for containing a compression spring;

an ejecting tube with a distal end being received into the containing chamber to be pressed by the compression spring, the ejecting tube having a guiding hole configured for guiding one of the shaft and the nail;

a nail magazine mounted at a side of the ejecting tube, the nail magazine having a guiding frame formed thereon;

a denticulate plate fixed on one of the main body and the connecting sleeve, the denticulate plate having a plurality of alveolus formed around the periphery thereof, a rotating table mounted on one of the main body and the connecting sleeve;

a mounting seat mounted at a side of the rotating table, the mounting seat having a chamber defined therein configured for containing the guiding frame;

a brake lever pivotally engaged with the rotating table, the brake lever having a block formed at a distal end thereof, and an elastic member arranged in the rotating table to push the brake lever for resisting movement of the block by the alveolus.

2. The palm nailer as claimed in claim 1, further comprises a tray arranged on the connecting sleeve, and an elastic washer arranged between the tray and the rotating table.

3. The palm nailer as claimed in claim 1, further comprises a guiding tube arranged between the ejecting tube and the connecting sleeve.

4. The palm nailer as claimed in claim 1, wherein the rotating table comprises a protrusion, and the brake lever is pivotally engaged between the rotating table and the protrusion.

5. The palm nailer as claimed in claim 1, wherein the brake lever further comprises a glossa formed at a distal end thereof configured for convenient hand pushing.

* * * * *